United States Patent [19]

Douno

[11] 3,977,669

[45] Aug. 31, 1976

[54] STACKING APPARATUS FOR USE WITH PAPER SECURITY VALIDATION APPARATUS OR THE LIKE

[75] Inventor: Syugo Douno, Himeji, Japan

[73] Assignee: Glory Kogyo Kabushiki Kaisha, Japan

[22] Filed: May 19, 1975

[21] Appl. No.: 579,078

[30] Foreign Application Priority Data

May 21, 1974 Japan ..... 49-57044

[52] U.S. Cl. ..... 271/180; 271/192; 271/224

[51] Int. Cl.[2] ..... B65H 31/34

[58] Field of Search ..... 271/176, 178, 180, 181, 271/189, 192, 219, 224

[56] References Cited

UNITED STATES PATENTS

| | | | |
|---|---|---|---|
| 2,904,335 | 9/1959 | Rabinow | 271/219 |
| 3,458,187 | 7/1969 | Draugelis et al. | 271/219 |
| 3,584,869 | 6/1971 | Traphagen | 271/180 |
| 3,655,186 | 4/1972 | Bayha | 271/180 |
| 3,716,227 | 2/1973 | Bottcher | 271/180 |
| 3,814,415 | 6/1974 | Hunter et al. | 271/176 |

FOREIGN PATENTS OR APPLICATIONS

| | | | |
|---|---|---|---|
| 1,216,887 | 5/1966 | Germany | 271/180 |

*Primary Examiner*—John J. Love
*Assistant Examiner*—Robert Saifer
*Attorney, Agent, or Firm*—Wenderoth, Lind & Ponack

[57] ABSTRACT

An apparatus for stacking pieces of paper money or the like as they are discharged one by one from a validation or like apparatus. The stacking apparatus includes a pair of horizontally spaced guide strips forming thereunder a passageway slanting downwardly from a horizontal slot through which the bills are introduced into the apparatus. Arranged for up-and-down movement along a substantially elliptic path across the passageway is a pusher adapted to press each incoming bill down into a storage chamber from the passageway, the storage chamber having a floating bottom which is spring biased upwardly. The bill pressed down into the storage chamber is held by means including a pair of retractable holder plates operating in synchronism with the up-and-down movement of the pusher.

4 Claims, 6 Drawing Figures

STACKING APPARATUS FOR USE WITH PAPER SECURITY VALIDATION APPARATUS OR THE LIKE

BACKGROUND OF THE INVENTION

This invention relates to an apparatus for receiving and stacking pieces of paper money, bonds, chits or slips, tickets, cards, or other pieces of paper or like material. More specifically, the invention deals with such a stacking apparatus well suited for use as an attachment to equipment for authentication of paper securities, for sorting or reading of cards, slips or the like, or for similar purposes.

A typical example of equipment with which the stacking apparatus of this invention is adaptable for use is disclosed in Bayha U.S. Pat. No. 3,457,421, issued July 22, 1969, under the title of "Radiation Sensitive Paper Security Validation Apparatus." It will be highly convenient for subsequent handling if the bills which have been identified as genuine by this and other validation apparatus can be withdrawn in the form of a neat stack. Special difficulties accompany the stacking operation of bills, however, because the validation apparatus is required to handle both brand-new bills and those which have been in circulation. The latter class of bills usually have several creases as they are often folded in two or four. While such bills can of course be supplied unfolded from the validation apparatus, they may not be nearly so flat or planar as brand-new bills.

SUMMARY OF THE INVENTION

It is therefore an object of this invention to provide an apparatus capable of neatly stacking articles such as pieces of paper money of the same denomination as they are supplied one by one.

Another object of the invention is to provide a stacking apparatus well adapted to be integrally appended to paper security validation or other equipment so that paper money or the like which has undergone the necessary processing in the equipment can be withdrawn in the form of a neat stack.

A further object of the invention is to provide a stacking apparatus which will work equally well either with uncreased, brand-new bills or with those which have been in circulation.

With all these and other objects in view, this invention provides a stacking apparatus including a casing having a vertical wall or panel through which there is formed a horizontal slot for the introduction of articles to be stacked. Within the casing a storage chamber is formed which has an upwardly biased floating bottom, and arranged over the storage chamber is guide means for forming a passageway slanting downwardly from the slot along which each incoming article is caused to travel. A pusher is provided which is movable up and down across the passageway to press each incoming article down onto the floating bottom of the storage chamber. Drive means connected to the pusher causes same to make the up-and-down movement along a substantially elliptic path such that the article can be neatly deposited on the floating bottom. Holder means restrains the successively stacked articles within the storage chamber.

The above mentioned vertical wall or panel can be attached directly to a paper money validation apparatus or the like. Genuine pieces of paper money which have been identified by the validation apparatus can be fed successively into the stacking apparatus through the slot and can be withdrawn from the latter in the form of a neat stack.

The features which are believed to be novel and characteristic of this invention are set forth in particular in the appended claims. The invention itself, however, both as to its organization and mode of operation, together with the further objects and advantages thereof, will become apparent in the course of the following description of a typical embodiment, which is to be read in connection with the accompanying drawings in which like reference characters refer to like parts throughout the several views.

DETAILED DESCRIPTION

Figure 1:
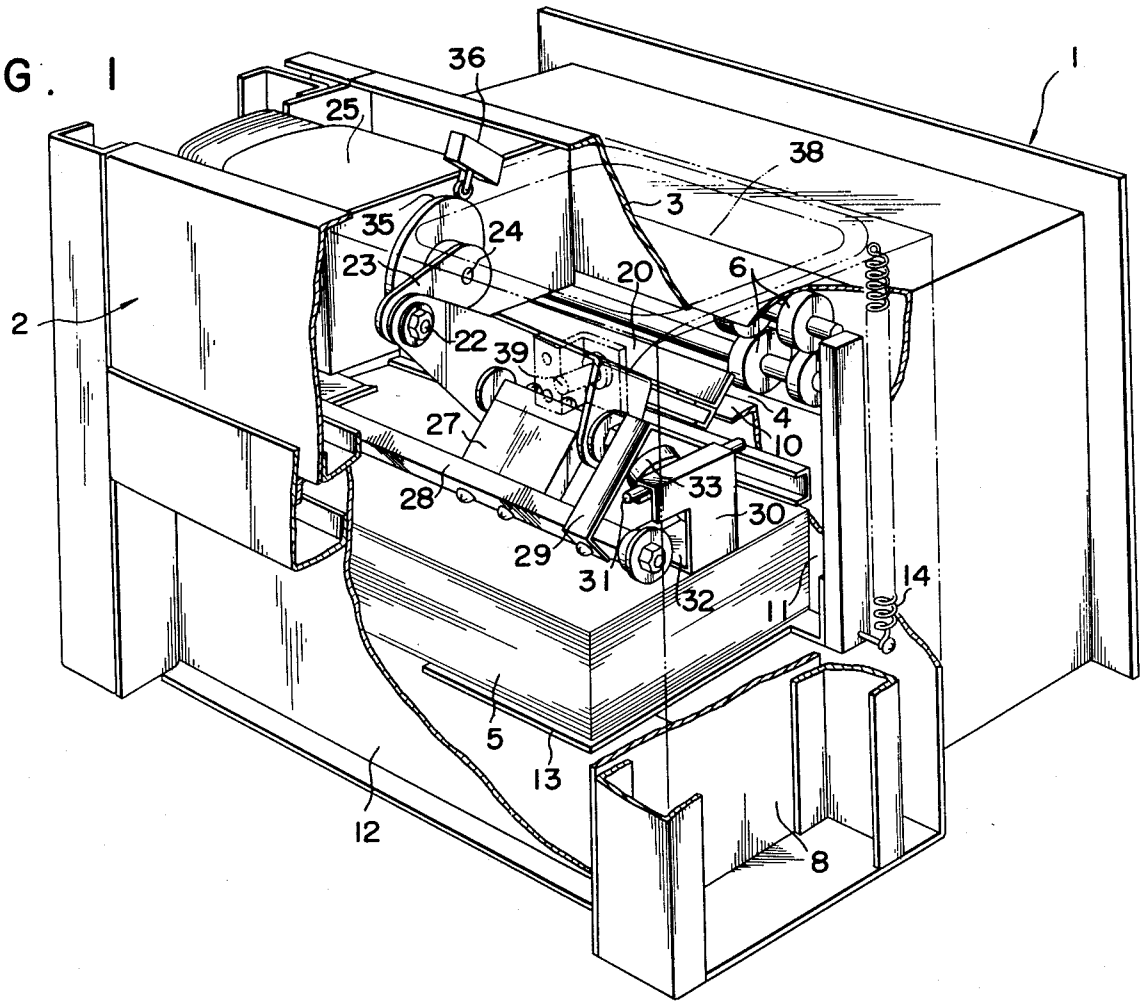
FIG. 1 is a perspective view of the stacking apparatus of the invention as adapted for use with a known paper money validation apparatus, the casing of the stacking apparatus being shown partly broken away to illustrate the inner details.

In the accompanying drawings the stacking apparatus according to this invention is shown specifically adapted for use with a known paper money validation apparatus 1 of the type disclosed in the U.S. patent noted earlier in this specification. With reference first and in particular to FIGS. 1, 2 and 3, the stacking apparatus includes a substantially rectangular casing 2 having a rear panel or wall 3 connected directly to the paper money validation apparatus 1. The rear panel 3 has a horizontally elongated aperture or slot 4 therethrough for accepting genuine pieces of paper money 5 of a predetermined denomination as they are successively dispensed out of the validation apparatus 1 as by pairs of friction rollers 6 mounted therein.

Within the casing 2 a pair of horizontally spaced, downwardly inclined guide strips 7 extend forwardly or inwardly from the top edge of the slot 4 in the rear panel 3 to form thereunder a passageway along which each incoming bill will travel. The guide strips 7, which can be secured to respective opposed side panels or walls 8, are each shown to terminate in an abutment 9 formed by bending the front end of each strip vertically downwardly. These abutments 9 are designed to temporarily or instantaneously arrest, or retard, the movement of each incoming bill along the passageway under the guide strips 7.

It should be well noted, however, that the provision of these abutments 9 is not absolutely necessary, as will be later explained in more detail. Another guide 10 may be formed along the bottom edge of the slot 4 by right-angularly or inwardly bending the part of the rear panel 3 to be slotted.

Arranged under the guide strips 7 is a generally rectangular paper money storage chamber 11 which is sized to suit the paper money 5 of the particular denomination to be delivered from the validation apparatus 1. The storage chamber 11 is defined by the rear panel 3, a pivotally openable lid 12 in confronting relationship to the rear panel, the opposed side panels 8, and a floating bottom 13 which is arranged for up-and-down movement within the chamber and which is biased upwardly as by helical tension springs 14. The paper money 5 from the validation apparatus 1 is to be stacked up in this storage chamber 11.

An overhanging stationary holder 15 mounted on the rear panel 3 at the upper extremity of the storage chamber 11 is adapted to hold the rear edge of the stack of paper money 5 accommodated therein. Another overhang 16 projecting from the lid 12 is intended to serve as a stop for preventing each incoming bill from jumping over the storage chamber 11. A suitable lock mechanism 17 should preferably be provided on the lid 12 so that same may be opened only by an authorized person carrying the key 18.

Figure 4:
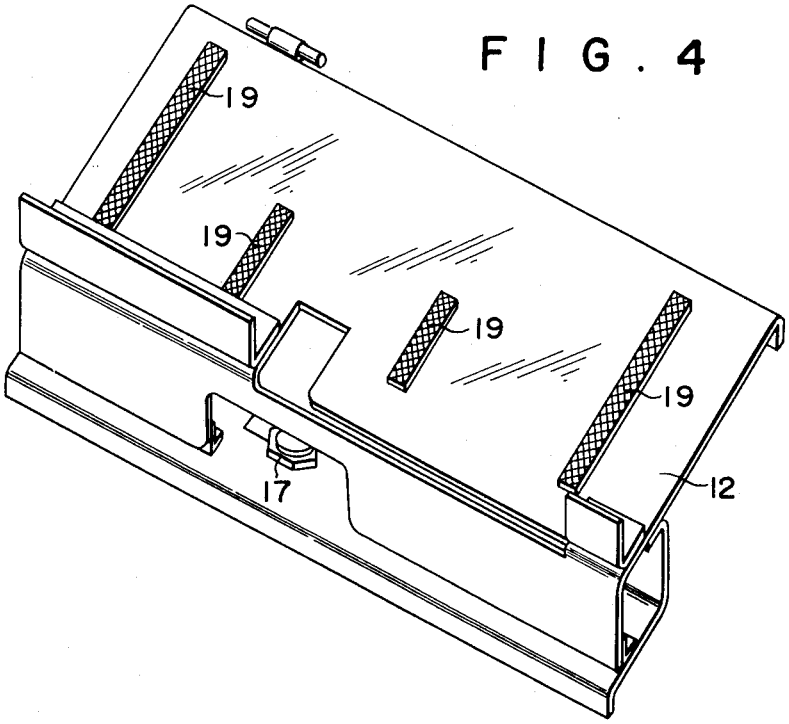
FIG. 4 is a perspective detail view of a lid constituting a part of the casing of the stacking apparatus.

As best shown in FIG. 4, a plurality of relatively thin strips 19 of rubber or other rubbery material are bonded or otherwise secured vertically to the internal surface of the lid 12. The strips 19 have a number of small raised dots, ridges or like knurls formed on their surfaces facing the storage chamber 11. Alternatively, the entire internal surface of the lid 12 may be covered with such a knurled sheet of rubbery material. As will become apparent from the succeeding description of operation, the knurled sheet or strips are designed to cooperate with the guide strips 7, with or without the abutments 9, to aid in the neat stacking of paper money in the storage chamber 11.

Figure 5:
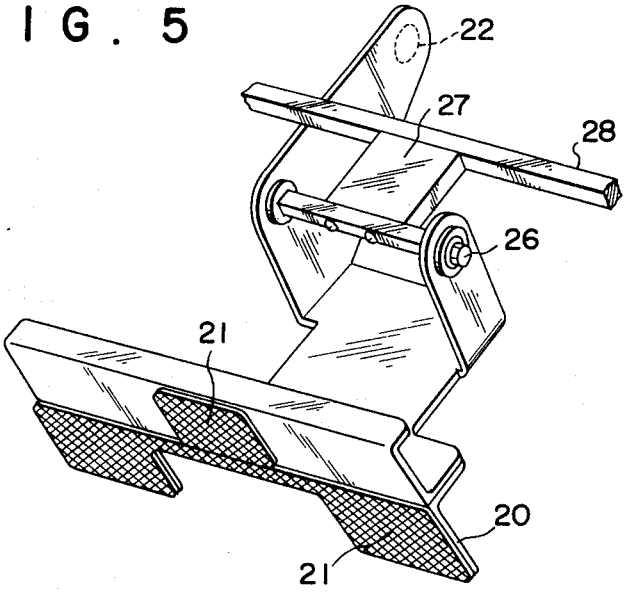
FIG. 5 is a perspective detail view of a pusher used in the stacking apparatus.

Arranged for up-and-down movement across the passageway of paper money 5 under the guide strips 7 is a pusher 20 of substantially inverted-T-shaped cross section. As illustrated in greater detail in FIG. 5, a sheet 21 of rubber or like material having a high coefficient of friction is bonded or otherwise secured to all or a selected part of the bottom surface of the pusher 20 for pressing each incoming bill down onto the stack, if any, formed on the floating bottom 13 of the storage chamber 11. The area of the bottom surface of the pusher 20 should be sufficiently large to afford firm contact with each incoming bill.

The pusher 20 is rotatably pinned at its top end 22 to a crank arm 23 fixedly mounted on the output shaft 24 of an electric motor 25 or like rotary actuator. The pusher 20 is further rotatably pinned at its intermediate point 26 to the free end of a swingable arm 27 which is secured at the other end to a horizontal shaft 28 rotatably journaled at both ends in the side panels 8. Hence, as the motor output shaft 24 rotates in the direction marked by the arrow in FIGS. 2 and 6, the pusher 20 will travel up and down along a substantially elliptic path.

The modifier "substantially" is added because the path of travel of the pusher 20 is not exactly elliptic. Instead, it will travel along a more or less arcuate path on its downward stroke and substantially vertically on its upward stroke, as will be seen from a consideration of FIG. 6. The above described drive mechanism of the pusher 20 is also well calculated so that the traveling speed of the pusher will be faster on its downward stroke to assure more positive, efficient pushing operation of each incoming bill down into the storage chamber 11.

It will be apparent that the shaft 28 rotates through a predetermined angle in alternate directions with the up-and-down movement of the pusher 20. A pair of holder actuator arms 29 are fixedly mounted at or adjacent both ends of this shaft 28 for actuating a pair of retractable holder plates 30, respectively, in synchronism with the up-and-down movement of the pusher 20.

Each holder plate 30 is pivotally supported by a pin 31 for swinging movement between an operative position over the stack of paper money 5 in the storage chamber 11 and an inoperative or retracted position away from over the stack, through an aperture formed in each side panel 8. The holder plates include portions 32 angled inwardly for directly overlying the stack of paper money 5 at both lateral ends thereof when the holder plates are in their operative positions best illustrated in FIG. 3. The aforesaid holder actuator arms 29 are arranged for abutting contact with respective rollers 33 that are rotatable independently of, but pivotable simultaneously with, the holder plates 30.

Thus, as the holder actuator arms 29 become pressed against the rollers 33 during the downward travel of the pusher 20, the holder plates 30 will retract to their inoperative positions before the pusher presses the incoming piece of paper money 5 down to the stack formed in the storage chamber 11. The holder plates will then automatically return to their operative positions under their own weight as the pusher 20 succeedingly travels upwardly.

Figure 2:
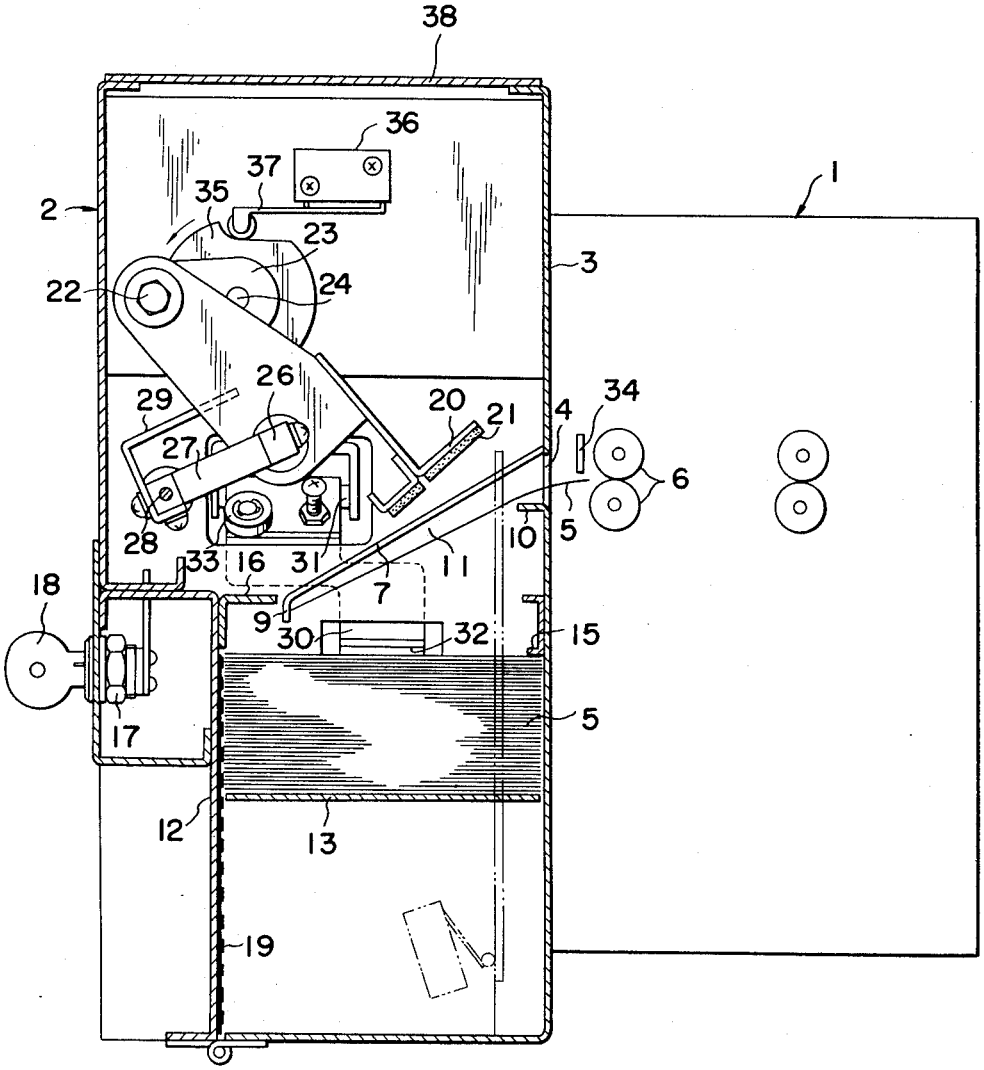
FIG. 2 is a side view showing the inner details of the stacking apparatus of FIG. 1.
Figure 3:
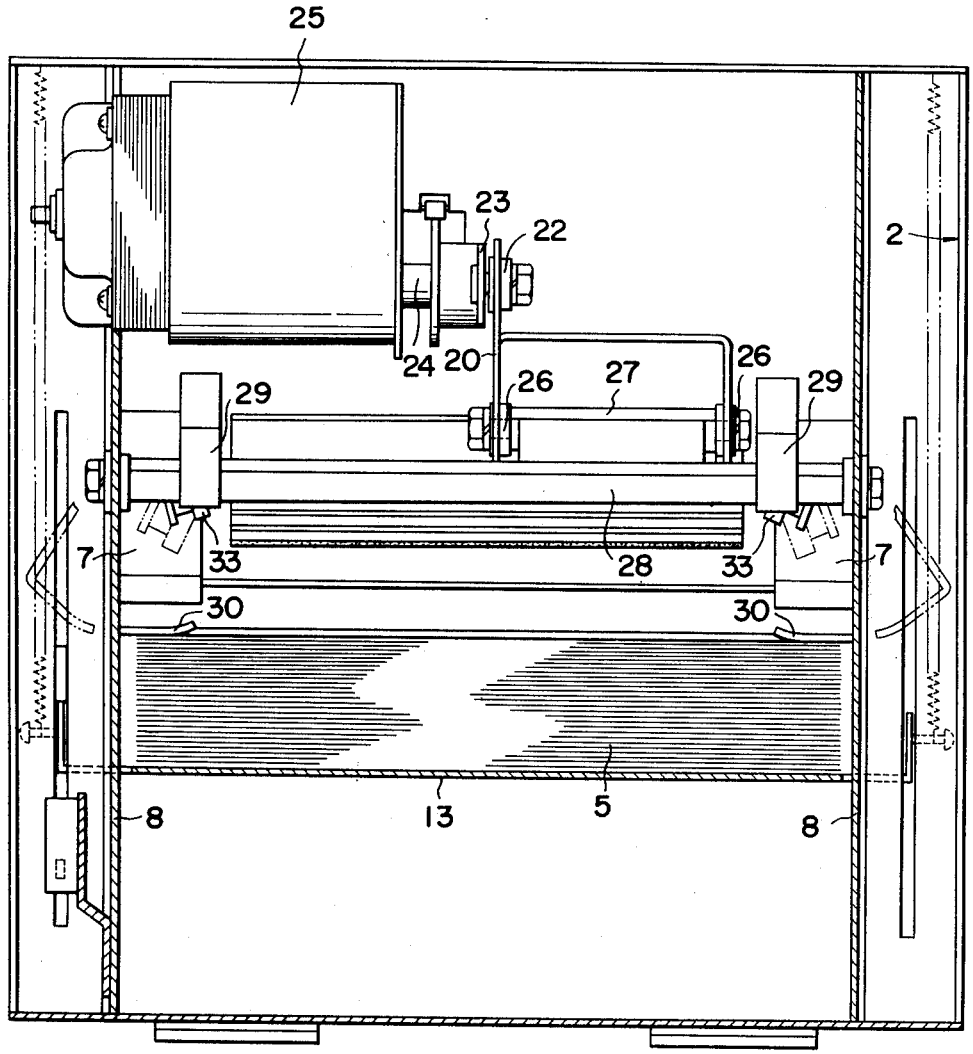
FIG. 3 is a front view also showing the inner details of the stacking apparatus of FIG. 1.

Shown at 34 in FIG. 2 is a switch of any known or suitable type which is to be actuated upon completion of delivery of each bill into the stacking apparatus. The switch 34 when thus actuated will initate the rotation of the motor 25 to cause the desired operations of the pusher 20 and retractable holder plates 30. A cam wheel 35 fixedly mounted on the motor output shaft 24 has its circumference so contoured as to actuate a switch 36 via its actuator arm 37, and hence stop the operation of the motor, upon each complete revolution of the output shaft.

As best illustrated in FIG. 1, a part of the top of the casing 2 is covered with a transparent sheet of plastic or like material to provide a viewing window 38. The operator may observe through this window 38 the interior of the casing 2 to see if the bills are being stacked properly. In the event of jamming of any incoming bill, for example, the operator may depress a push buttom 39 provided within his easy reach. The depression of the button 39 is assumed to forcibly set the motor 25 in rotation, so that the pusher 20 will operate to bring the jamming bill down to the stack in the storage chamber 11.

In operation, each genuine bill 5 which has been validated by the validation apparatus 1 is introduced into the stacking apparatus through its slot 4. As will be seen from FIG. 2, the bill will then travel along the passageway under the downwardly slanting guide strips 7 until its leading edge moves into contact with the abutments 9, whereupon the movement of the bill is temporarily arrested or retarded. At this juncture the switch 34 within the validation apparatus 1 senses the delivery of the bill into the stacking apparatus and consequently actuates the motor 25.

Figure 6:
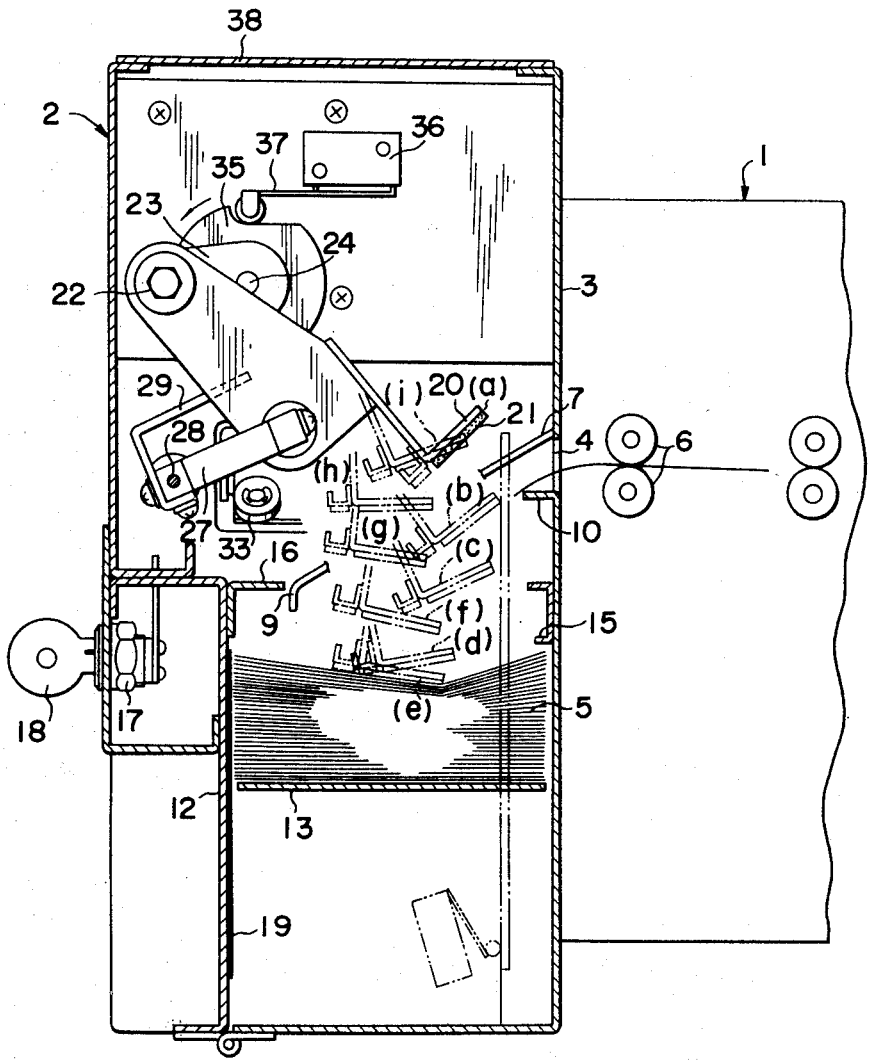
FIG. 6 is a view similar to FIG. 2 but explanatory of the operation of the stacking apparatus.

As represented in FIG. 6, the actuated motor 25 causes the pusher 20 to descend from its topmost or standby position *a* to the lowermost position *e* through positions *b*, *c* and *d*, thereby pressing the incoming bill down to the stack, if any, of the preceding bills formed on the floating bottom 13 of the storage chamber 11. It will be noted that the pusher 20 follows an arcuate path as it descends to press the incoming bill downwardly. As a consequence, the pusher will feed the bill forwardly, that is, toward the lid 12, only to such an extent that the bill will neatly overlie the stack in the storage chamber 11.

The descent of the pusher 20 causes the shaft 28 to rotate clockwise, as seen in FIGS. 2 and 6, through a predetermined angle, with the result that the holder actuator arms 29 mounted thereon become pressed against the respective rollers 33 pivotable with the retractable holder plates 30. The holder plates 30 are therefore pivoted away to their inoperative positions indicated by the dot-and-dash lines in FIG. 3, thereby permitting the incoming bill to be placed directly over the stack. Since the bill is slightly fed forwardly by the pusher 20 as aforesaid, its trailing edge will be caught under the stationary holder 15 as the pusher succeedingly releases the bill.

As the crank arm 23 on the output shaft 24 of the motor 25 further rotates in the direction, of the arrow the pusher 20 will ascend to the initial standby position *a* through positions *f*, *g*, *h* and *i*, thus following a substantially vertical path. The ascent of the pusher 20 causes the shaft 28 to rotate counterclockwise so that the holder actuator arms 29 will swing away from the rollers 33 to permit the holder plates 30 to return by gravity to their operative positions over the stack of paper money in the storage chamber 11.

The foregoing cycle is repeated to form a neat stack in the storage chamber 11 of the bills successively delivered from the validation apparatus 1. The floating bottom 13 of the storage chamber, of course, descends against the bias of the tension springs 14 by small increments with the increase in the number of bills stacked.

While the abutments 9 at the front ends of the guide strips 7 are intended to temporarily arrest or retard the movement of each incoming bill as above explained, the provision of these abutments is not essential for the successful operation of the stacking apparatus according to the invention, either with crisp, brand-new bills or those which have been in circulation.

The bills which have been in circulation for a long time usually have several creases as the bills are sometimes carried by being folded in two or four. If such a creased bill is introduced into the stacking apparatus, it will become caught in the slot 4 when released from the rollers 6 and will thus temporarily stop at the passageway under the guide strips 7 without the aid of the abutments 9. A brand-new or uncreased bill, on the other hand, will have its leading edge caught between the raised dots or other knurls on the sheet or strips 19 or rubbery material on the internal surface of the lid 12 and will thus also stop while being still partly located in the passageway. Both creased and uncreased bills can therefore be neatly stacked as the pusher 20 travels the substantially elliptic path.

While the stacking apparatus according to the invention has been shown and described hereinbefore in terms of its specific adaptation, the invention itself is not intended to be restricted by the exact showing of the drawings or the description thereof. It is therefore appropriate that the invention be construed broadly and in a manner consistent with the fair meaning or proper scope of the following claims.

What is claimed is:

1. An apparatus for stacking articles such as pieces of paper money as they are delivered one by one, comprising a casing having a horizontally extending slot for receiving the articles, partition means for defining a storage chamber within said casing and under said slot and including a floating bottom which is biased upwardly and on which the articles are to be stacked, guide means for forming a passageway slanting downwardly from said slot thereby to cause travel of each incoming article along said passageway, a pusher adjacent said passageway for pushing each incoming article downward, drive means for causing said pusher to move up and down, and holder means for holding each incoming article on said storage chamber, said drive means having a rotary actuator having an output shaft, a crank arm fixedly mounted at one end on said output shaft and rotatably connected at the other end to the top end of said pusher, and a swingable arm having a free end rotatably connected to said pusher at a point intermediate the top and bottom ends thereof, whereby said pusher is made to move up and down along a substantially elliptical path for pressing each incoming article down onto said floating bottom from said passageway.

2. An apparatus for stacking articles as claimed in claim 1, wherein said holder means includes a pair of retractable holder plates and is provided with drive means for moving said holder plates between operative positions over the stack of articles on said floating bottom of said storage chamber and inoperative positions spaced laterally away from the operative positions over the article stack in synchronism with the up-and-down movement of said pusher.

3. An apparatus for stacking articles as claimed in claim 2, wherein said holder plates are pivotally supported for swinging movement between the operative and inoperative positions, said holder plates being normally held in said operative positions under their own weight, and wherein said drive means for moving said holder plates comprises a rotatable shaft on which said swingable arm is mounted, whereby said rotatable shaft is made to rotate through a predetermined angle in alternate directions with the up-and-down movement of said pusher, and a pair of holder actuator arms extending from said rotatable shaft to cause said holder plates to swing to their inoperative positions during the descent of said pusher.

4. A stacking apparatus as claimed in claim 3, wherein said partition means includes a vertical wall and said holder means further includes a stationary holder projecting inwardly from said vertical wall.

* * * * *